US006474692B1

(12) United States Patent
Farah

(10) Patent No.: US 6,474,692 B1
(45) Date of Patent: Nov. 5, 2002

(54) COMPACT SITTING AND BRAKING DEVICE FOR USE WITH SKATES

(76) Inventor: David B. Farah, 4361 NE. Division, Gresham, OR (US) 97030

( * ) Notice: Subject to any disclaimer, the term of this patent is extended or adjusted under 35 U.S.C. 154(b) by 0 days.

(21) Appl. No.: 09/663,164

(22) Filed: Sep. 15, 2000

Related U.S. Application Data

(63) Continuation-in-part of application No. 09/248,706, filed on Feb. 11, 1999, now abandoned, which is a continuation-in-part of application No. 09/015,110, filed on Jan. 29, 1998, now abandoned.

(51) Int. Cl.[7] ..... A63C 17/28
(52) U.S. Cl. ..... 280/826
(58) Field of Search ..... 280/11.221, 809, 280/816, 819, 823, 826; 188/5, 19; 403/100; 16/223, 231, 324

(56) References Cited

U.S. PATENT DOCUMENTS

| | | | | | |
|---|---|---|---|---|---|
| 339,788 | A | * | 4/1886 | Kayes | 280/826 |
| 1,535,461 | A | * | 4/1925 | Frevert | 280/826 |
| 1,541,763 | A | * | 6/1925 | Dunberg | 280/826 |
| 1,608,238 | A | * | 11/1926 | Riefschnider | 280/826 |
| 1,701,798 | A | * | 2/1929 | Shone | 280/826 |
| 1,981,317 | A | * | 11/1934 | Jaglowicz | 280/826 |
| 2,027,388 | A | * | 1/1936 | Larkin | 280/826 |
| 2,148,644 | A | * | 2/1939 | Riefschnider | 280/826 |
| 2,592,230 | A | * | 4/1952 | Allen | 16/223 |
| 3,421,773 | A | * | 1/1969 | Pearson | 280/826 |
| 4,141,665 | A | * | 2/1979 | Snapp, Jr. | 403/100 |
| 4,386,794 | A | * | 6/1983 | Roberts | 280/826 |
| 4,527,579 | A | * | 7/1985 | Knotter et al. | 403/100 |
| 5,178,583 | A | * | 1/1993 | Rankin | 403/100 |
| 5,312,135 | A | * | 5/1994 | Karabass | 280/826 |
| 5,388,844 | A | * | 2/1995 | Pellegrini, Jr. et al. | 280/11.214 |
| 5,687,991 | A | * | 11/1997 | Gairdner | 280/826 |
| 6,142,526 | A | * | 11/2000 | Katz | 280/809 |

FOREIGN PATENT DOCUMENTS

| | | | | |
|---|---|---|---|---|
| EP | 572880 | * | 12/1993 | 280/826 |

* cited by examiner

*Primary Examiner*—Frank Vanaman

(57) ABSTRACT

A braking device for use with skates includes an elongated stick having forward and rearward ends and a ground surface engagement member mounted on the rearward end of the elongated stick. The stick comprises a forward component and a rearward component, the forward component of the stick being pivotally mounted to the rearward component of the stick such that the components of the stick are pivotable between an extended deployed condition for use and a folded condition for storage. The ground surface engagement member is pivotally mounted on the rearward end for adapting to an orientation of a ground surface with respect to a longitudinal axis of the stick. A pivot stop may be provided for limiting the pivot movement of the ground surface engagement member. A biasing spring may be linked between the stick and the ground surface engagement member for biasing the base member into a position having the brake surface oriented substantially parallel to a longitudinal axis of the stick. A seat may be coupled to the stick. The seat is pivotally mounted on the stick, the seat being pivotable between a use position and a storage condition, with the use position being characterized by the seat being oriented substantially perpendicular to the stick and the storage position being characterized by the seat being oriented substantially parallel to the stick.

19 Claims, 13 Drawing Sheets

COMPACT SITTING AND BRAKING DEVICE FOR USE WITH SKATES

RELATED APPLICATION

The present application is a continuation-in-part application of our U.S. patent application Ser. No. 09/248,706 filed Feb. 11, 1999, abandoned, which is a continuation-in-part application of our U.S. patent application Ser. No. 09/015,110, filed Jan. 29, 1998, abandoned, which is incorporated herein by reference.

BACKGROUND OF THE INVENTION

1. Field of the Invention

The present invention relates to braking devices and more particularly pertains to a new braking device for use with skates for braking during use of skates and further providing a training aid for skate users.

2. Description of the Prior Art

The use of braking and seating devices for use with skates is known in the prior art. The devices are typically carried by a user as he or she skates, and are typically used on occasions when slowing or stopping of forward skating movement is desired. However, the known devices have generally been bulky and heavy, which has made these devices difficult to carry and store between usages of the devices. The devices have also been difficult to tote along during usage, such as for long stretches of skating where braking is not likely to be needed.

The braking device for use with skates according to the present invention substantially departs from the conventional concepts and designs of the prior art, and in so doing provides an apparatus primarily developed for the purpose of providing a lightweight, highly compact and easy to carry braking device for skate users.

SUMMARY OF THE INVENTION

In view of the foregoing disadvantages inherent in the known types of braking devices now present in the prior art, the present invention provides a new braking device for use with skates construction wherein the same can be utilized for braking during use of skates and further providing a training aid for skate users.

The general purpose of the present invention, which will be described subsequently in greater detail, is to provide a new braking device for use with skates apparatus and method which has many of the advantages of the braking devices mentioned heretofore and many novel features that result in a new braking device for use with skates which is not anticipated, rendered obvious, suggested, or even implied by any of the prior art braking devices, either alone or in any combination thereof.

To attain this, the present invention generally comprises an elongated stick having forward and rearward ends and a ground surface engagement member mounted on the rearward end of the elongated stick. The stick comprises a forward component and a rearward component, the forward component of the stick being pivotally mounted to the rearward component of the stick such that the components of the stick are pivotable between an extended deployed condition for use and a folded condition for storage. The ground surface engagement member is pivotally mounted on the rearward end for adapting to an orientation of a ground surface with respect to a longitudinal axis of the stick. A pivot stop may be provided for limiting the pivot movement of the ground surface engagement member. A biasing spring may be linked between the stick and the ground surface engagement member for biasing the base member into a position having the brake surface oriented substantially parallel to a longitudinal axis of the stick. A seat may be coupled to the stick. The seat is pivotally mounted on the stick, the seat being pivotable between a use position and a storage condition, with the use position being characterized by the seat being oriented substantially perpendicular to the stick and the storage position being characterized by the seat being oriented substantially parallel to the stick.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new braking device for use with skates apparatus and method which has many of the advantages of the braking devices mentioned heretofore and many novel features that result in a new braking device for use with skates which is not anticipated, rendered obvious, suggested, or even implied by any of the prior art braking devices, either alone or, in any combination thereof.

It is another object of the present invention to provide a new braking device for use with skates which may be easily and efficiently manufactured and marketed.

It is a further object of the present invention to provide a new braking device for use with skates which is of a durable and reliable construction.

An even further object of the present invention is to provide a new braking device for use with skates which is susceptible of a low cost of manufacture with regard to both materials and labor, and which accordingly is then susceptible of low prices of sale to the consuming public, thereby making such braking device for use with skates economically available to the buying public.

Still yet another object of the present invention is to provide a new braking device for use with skates which provides in the apparatuses and methods of the prior art some of the advantages thereof, while simultaneously overcoming some of the disadvantages normally associated therewith.

Still another object of the present invention is to provide a new braking device for use with skates for braking during use of skates and further providing a training aid for skate users.

Even still another object of the present invention is to provide a new braking device for use with skates that includes an elongated stick having forward and rearward ends and a ground surface engagement member mounted on the rearward end of the elongated stick. The stick comprises a forward component and a rearward component, the forward component of the stick being pivotally mounted to the rearward component of the stick such that the components of the stick are pivotable between an extended deployed condition for use and a folded condition for storage. The ground surface engagement member is pivotally mounted on the rearward end for adapting to an orientation of a ground surface with respect to a longitudinal axis of the stick. A pivot stop may be provided for limiting the pivot movement of the ground surface engagement member. A biasing spring may be linked between the stick and the ground surface engagement member for biasing the base member into a position having the brake surface oriented substantially parallel to a longitudinal axis of the stick. A seat may be coupled to the stick. The seat is pivotally mounted on the stick, the seat being pivotable between a use position and a storage condition, with the use position being characterized by the seat being oriented substantially perpendicular to the stick and the storage position being characterized by the seat being oriented substantially parallel to the stick.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
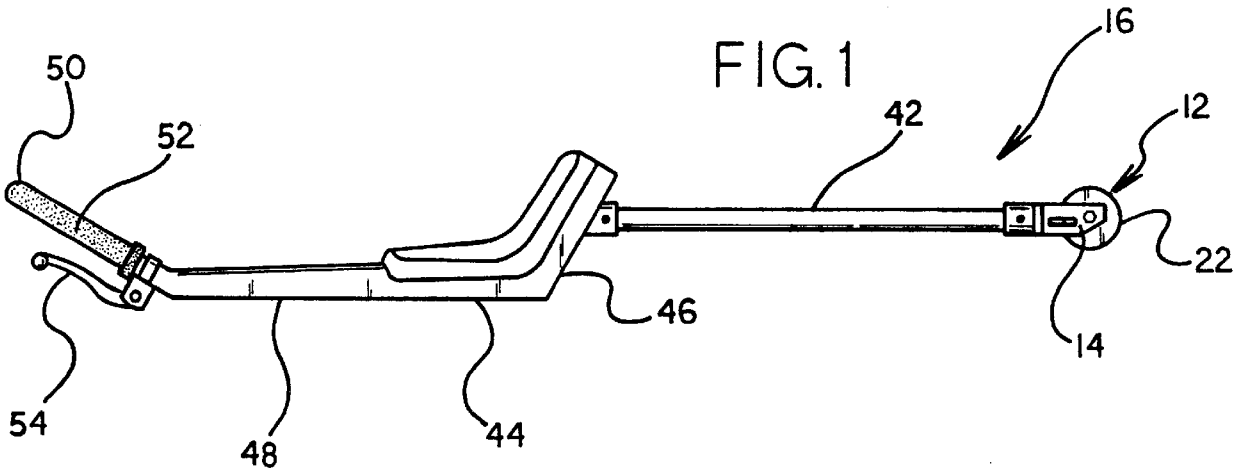
FIG. 1 is a side view of a new braking device for use with skates according to the present invention.

With reference now to the drawings, a new braking device for use with skates embodying the principles and concepts of the present invention and generally designated by the reference numeral will be described.

Figure 3:
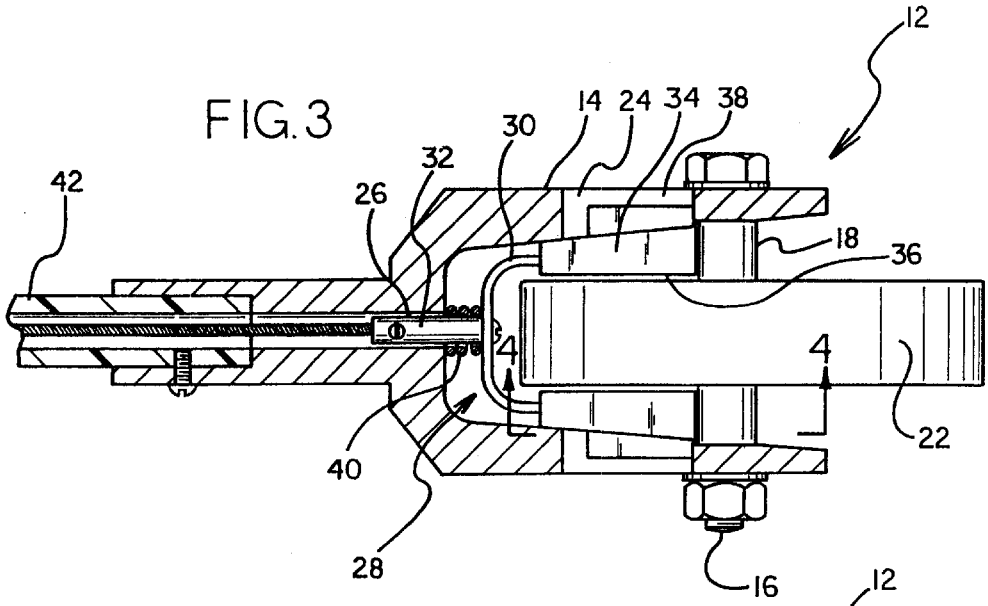
FIG. 3 is a cross-sectional view of the wheel and brake assemblies of the present invention.
Figure 4:
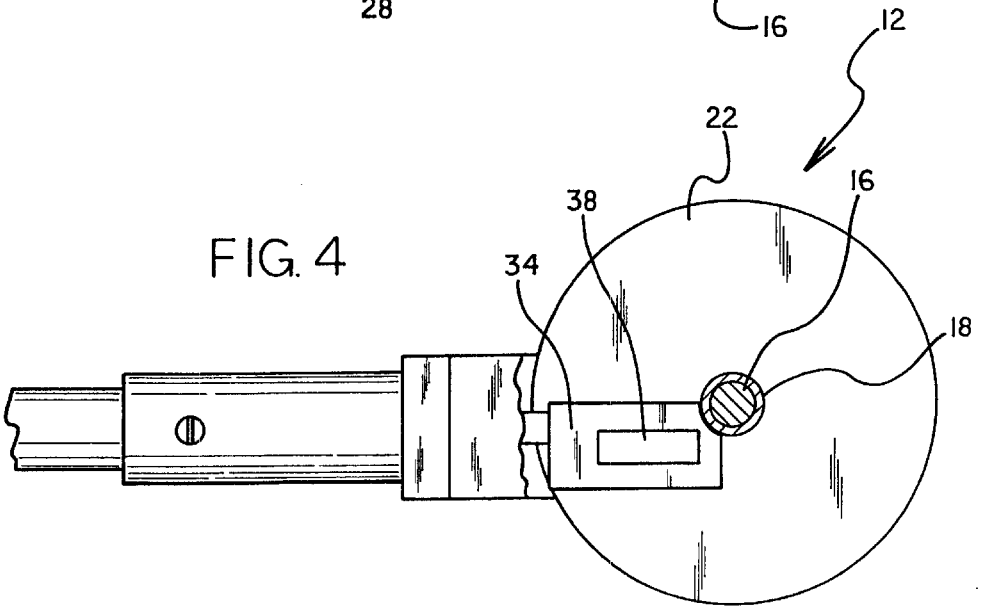
FIG. 4 is a side cross-sectional view of the brake and wheel assemblies of the present invention.

As shown in the Figures, the system 10 of the present invention includes a wheel assembly 12 with a fork defined by a pair of prongs 14. As best shown in FIG. 3, an axle 16,is coupled between ends of the prongs. In the present embodiment, the axle comprises a bolt 18 with a pair of spacers 20 situated on the bolt between the prongs. A disk-shaped wheel 22 is rotatably coupled to the axle between the spacers. It is imperative that the side faces of the wheel be flat. For reasons that will become apparent later, the fork has a pair of guide slots 24 formed in each of the prongs thereof adjacent the axle. Further, a bore 26 is formed in a front portion of the fork. Such bore is formed about an axis which intersects the axle perpendicularly. Note FIG. 3.

Next provided is a brake assembly 28 with a U-shaped member 30 having a post 32 coupled to an apex thereof. The post is slidably situated within the bore of the fork of the wheel assembly. The brake assembly further includes a pair of pads 34 coupled to ends of the U-shaped member and situated between the wheel and the corresponding prong of the fork. Each pad has a beveled interior edge 36 situated adjacent the wheel and a guide tab 38 slidably situated within the associated guide slot of the wheel assembly. Such guide tab constrains the motion of the pads by only allowing limited forward and rearward movement. A spring 40 is positioned about the post between the U-shaped member and the fork. By this structure, the pads have an unbiased orientation in spaced relationship with the wheel and a biased orientation upon the sliding of the post within the bore of the fork. In the biased orientation, the pads engage the wheel thereby precluding the rotation thereof.

Figure 2:
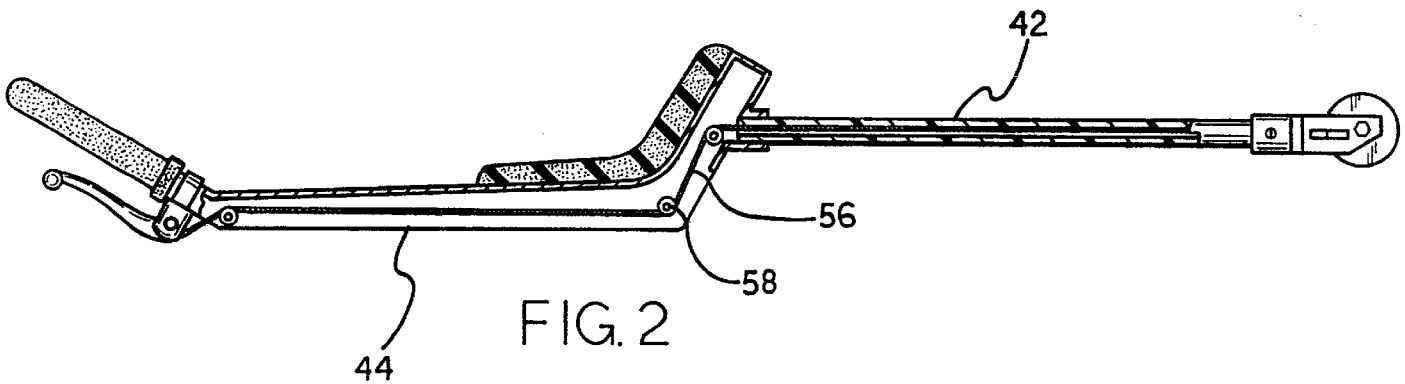
FIG. 2 is a cross-sectional view of the present invention.

With reference now to FIGS. 1 & 2, a rear extent defined by a hollow linear tube 42 is provided having a rear end coupled to the fork. It should be noted that in an alternate embodiment, the tube may have a slight arcuate bend. An intermediate extent is included having a generally L-shaped hollow housing 44. The L-shaped housing has a short generally vertical portion 46 coupled to a front end of the tube of the rear extent and a long horizontal portion 48 extending forwardly therefrom. In the preferred embodiment, the generally vertical portion defines between a 95–115 degree angle with respect to the horizontal portion. While not shown in the Figures, it is further preferred that the width of the horizontal portion be thin so as to be readily positionable in a crotch of a user.

The present invention further includes a front extent with a handle 50 having a cylindrical configuration. For gripping purposes, an elastomeric grip 52 is formed on the handle. As shown in FIGS. 1 & 2, the handle has an inboard end coupled to a front end of the horizontal portion and is extended upwardly and forwardly therefrom at an angle between 95–115 degrees. It should be noted that the rear extent, intermediate extent, and front extent generally reside in a common vertical plane.

Finally, a brake lever 54 is pivotally coupled adjacent the inboard end of the handle. The brake lever is coupled to the post of the brake assembly by way of a brake line 56. As such, the brake lever serves to allow selective sliding of the post within the associated bore thereby effecting braking. As shown in FIG. 2, the brake line passes through the hollow tube and both portions of the intermediate extent via a plurality of pulleys 58. The brake line further passes through a front end of the horizontal portion of the L-shaped housing whereat it is coupled the brake lever.

During operation with skates, such as for example in-line skates, a user simply places the horizontal portion of the intermediate extent between legs thereof. The user then engages the wheel with the ground and grips the handle. At any time, the user may then bias the brake lever thereby precluding forward movement. To afford additional braking action, the user may apply an upward force to the handle thereby engaging the wheel with the ground with a greater force by way of lever action. It should be noted that the present invention may further serve as a training/safety device for facilitating the use of the in-line skates. In an alternate embodiment shown in FIGS. 5 through 8, the wheel and brake lever are excluded in favor a different type of ground surface engagement means. Such surface engagement means includes a replaceable planar plastic piece 60 with a pair of peripheral flanges extending upwardly therefrom to define a fork for pivotally coupling to an end of the rear extent of the frame.

Figure 5:
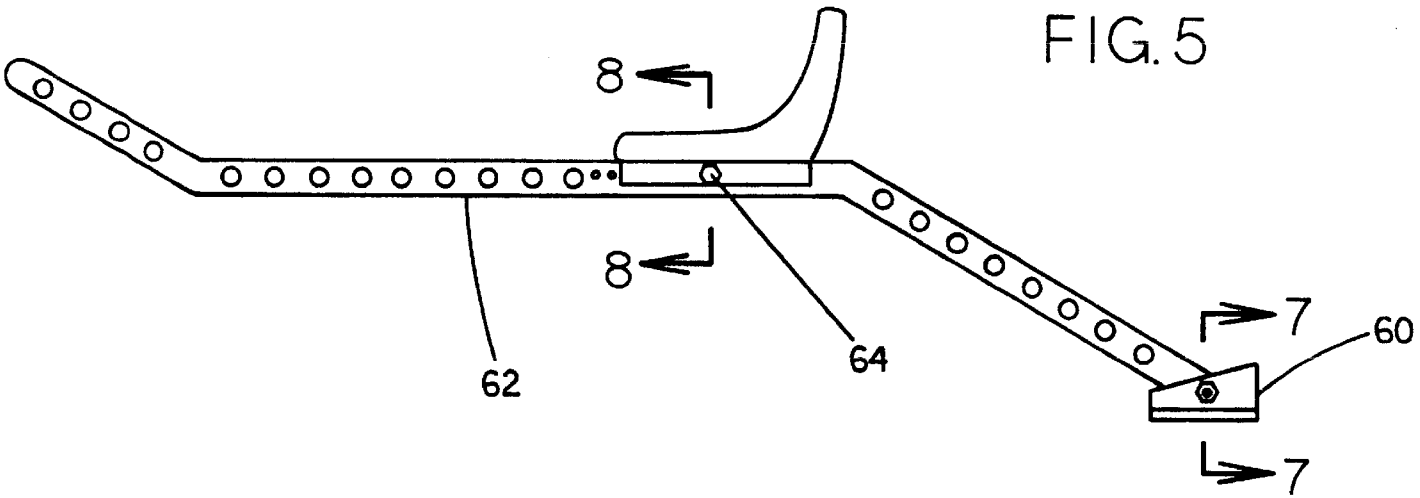
FIG. 5 is a side view of an optional embodiment of the present invention.
Figure 6:
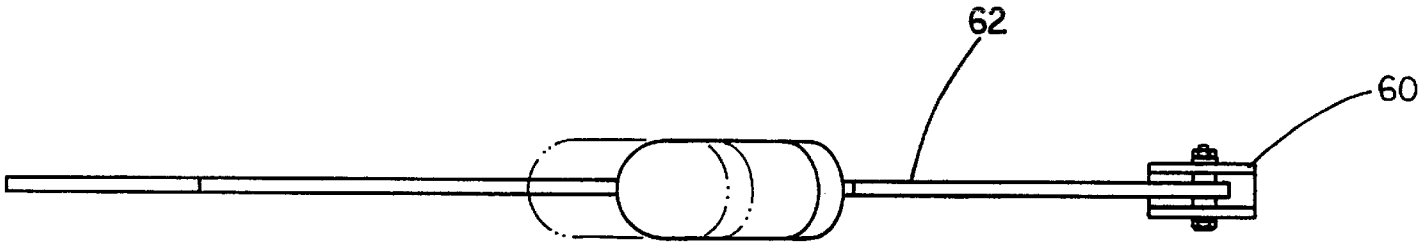
FIG. 6 is a top view of the optional embodiment of FIG. 5.
Figure 7:
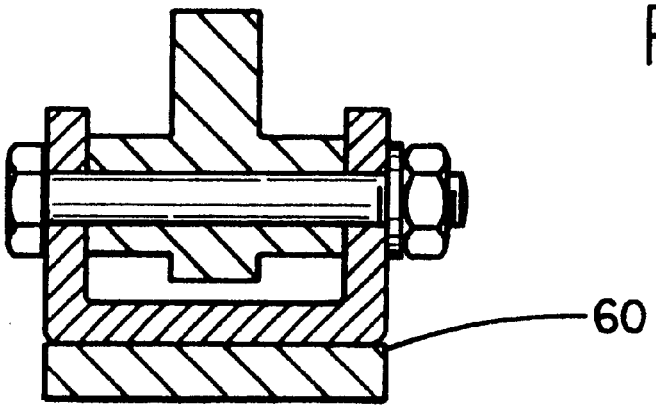
FIG. 7 is a cross-sectional view of the optional embodiment of the present invention taken along line 7—7 shown in FIG. 5.
Figure 8:
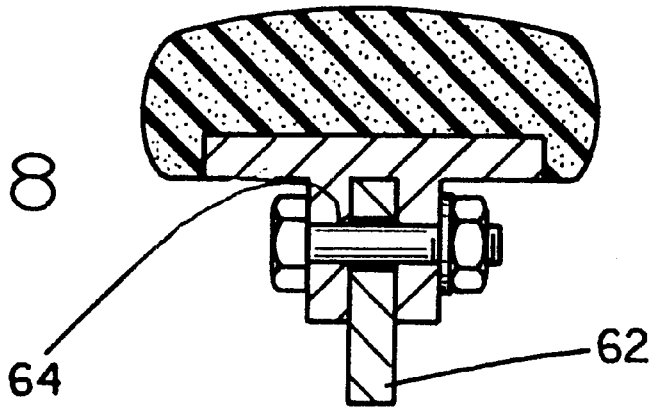
FIG. 8 is a cross-sectional view of the optional embodiment of the present invention taken along line 8—8 shown in FIG. 5.

As shown in FIG. 5, the rear extent of the present embodiment forms an obtuse angle of about 120 degrees with the front-extent. Further, both extents along with the handle comprise of an elongated planar aluminum strip 62. For reducing the weight of the strip while maintaining strength, a plurality of either circular or triangular cut outs are preferably formed therein. Note FIG. 5. As shown in FIGS. 5 & 8, the seat of the present embodiment is adjustable along at length of the front extent by way of a plurality of linearly aligned apertures and a bolt 64.

In various additional unillustrated alternate embodiments a motor may be employed to propel the wheel of the wheel assembly. To control the speed at which such motor imparts movement, a twist throttle is preferably incorporated on the handle.

Figure 9:
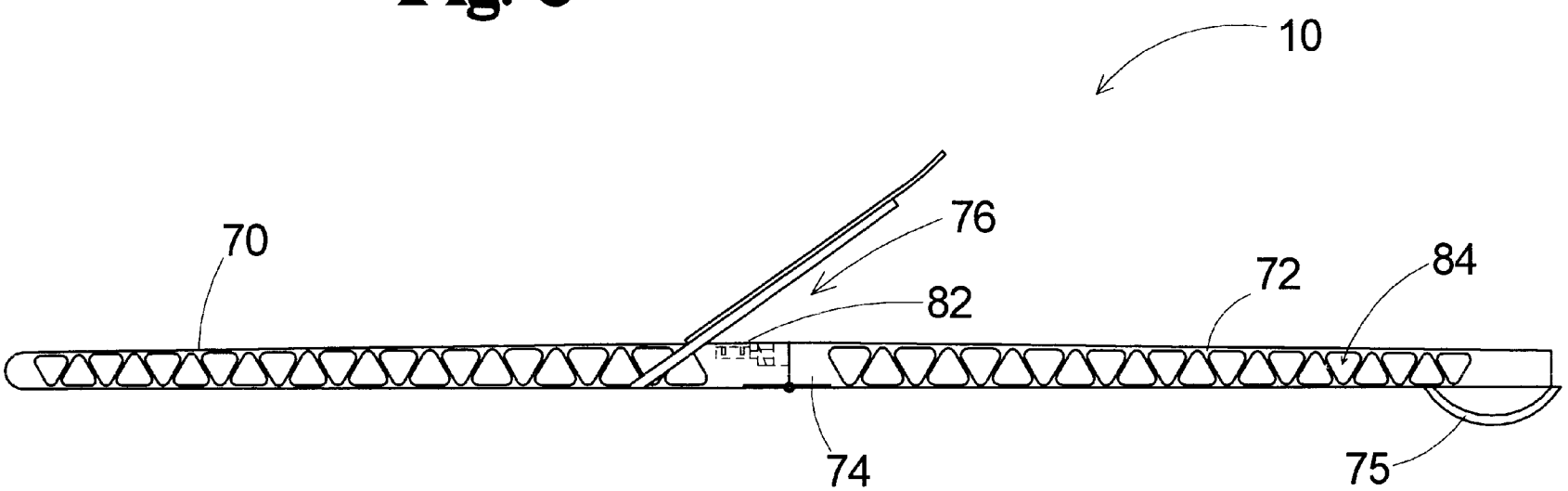
FIG. 9 is a side view of an optional embodiment of the present invention.
Figure 10:
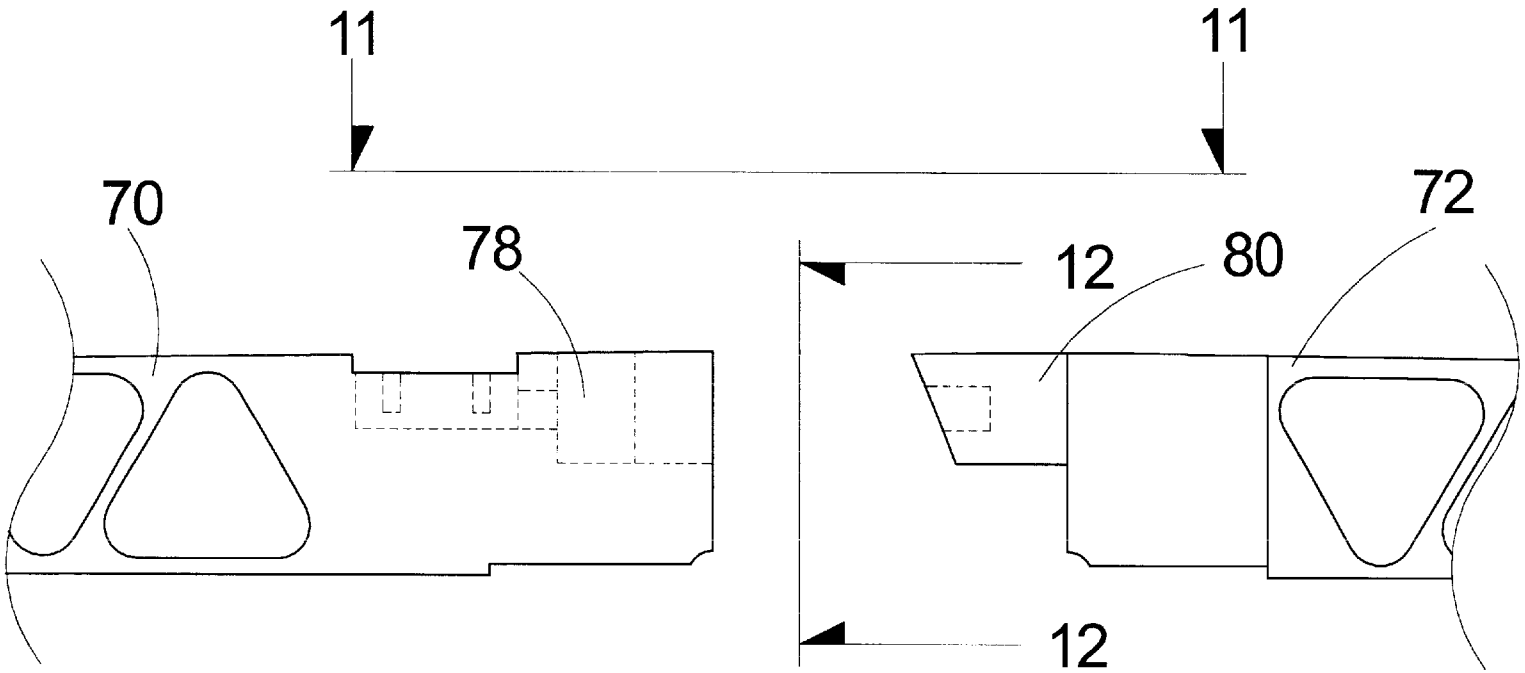
FIG. 10 is a detailed view of the two components of the present invention, as shown in FIG. 9.
Figure 11:
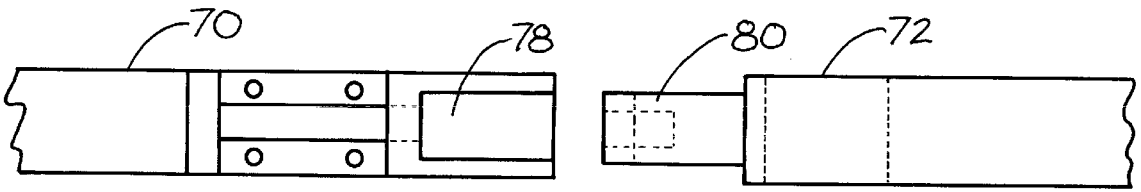
FIG. 11 is a top view of the two components of the present invention as taken along line 11—11 shown in FIG. 10.
Figure 13:
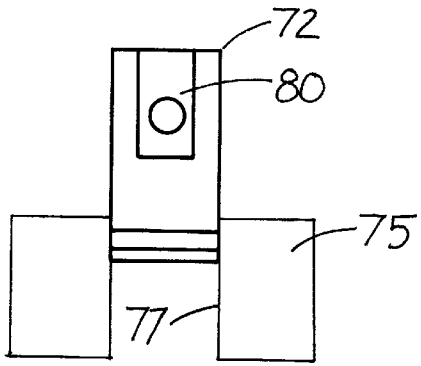
FIG. 13 is a front view of the rearward component of the present invention as shown in FIG. 10.
Figure 12:
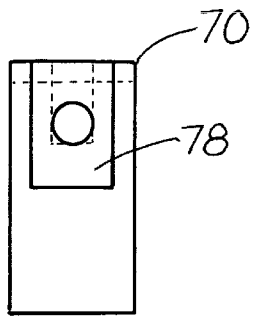
FIG. 12 is a front view of the forward component of the present invention taken along line 2—2 shown in FIG. 10.

In yet another alternate embodiment, as shown in FIGS. 9–13, a bar is provided that includes a forward component 70 and a rearward component 72 that are hingably coupled. This is preferably accomplished by a hinge 74 that is coupled along a lower surface of the forward and rearward components. By this structure, the forward and rearward components are adapted to be folded between a first orientation with the components in substantially co-linear relationship and a second orientation in a stacked relationship. In the preferred embodiment, a pair of the ground surface engagement members 75 are attached to the rearward component for defining a slot 77 in which the forward component is inserted when the components are folded Ideally, the braking device further includes a latch mechanism 76, as shown in FIG. 9, for maintaining the forward and rearward components in the first orientation. FIG. 10 shows a female recess 78 formed in the forward component along the top and rear faces thereof. Cooperating with the recess of the forward component is a male-protrusion 80 extending from the front face of the forward component adjacent to the top face thereof. For reasons that will soon become apparent, an end of the male protrusion is beveled. Positioned inwardly of the female recess is a resilient strip 82 that engages the beveled end of the male protrusion to accomplish the task of the latch mechanism.

Further modifications relating to the present embodiment of the present invention include a plurality of triangular cut outs 84 formed in the bar to afford a more light weight device that still exhibits optimal strength. In addition, the seat of the present embodiment is mounted adjacent to the latch mechanism of the forward component of the bar. As shown in FIG. 9, the seat extends rearwardly at an angle of about 30 degrees with respect to the bar.

Figure 14:
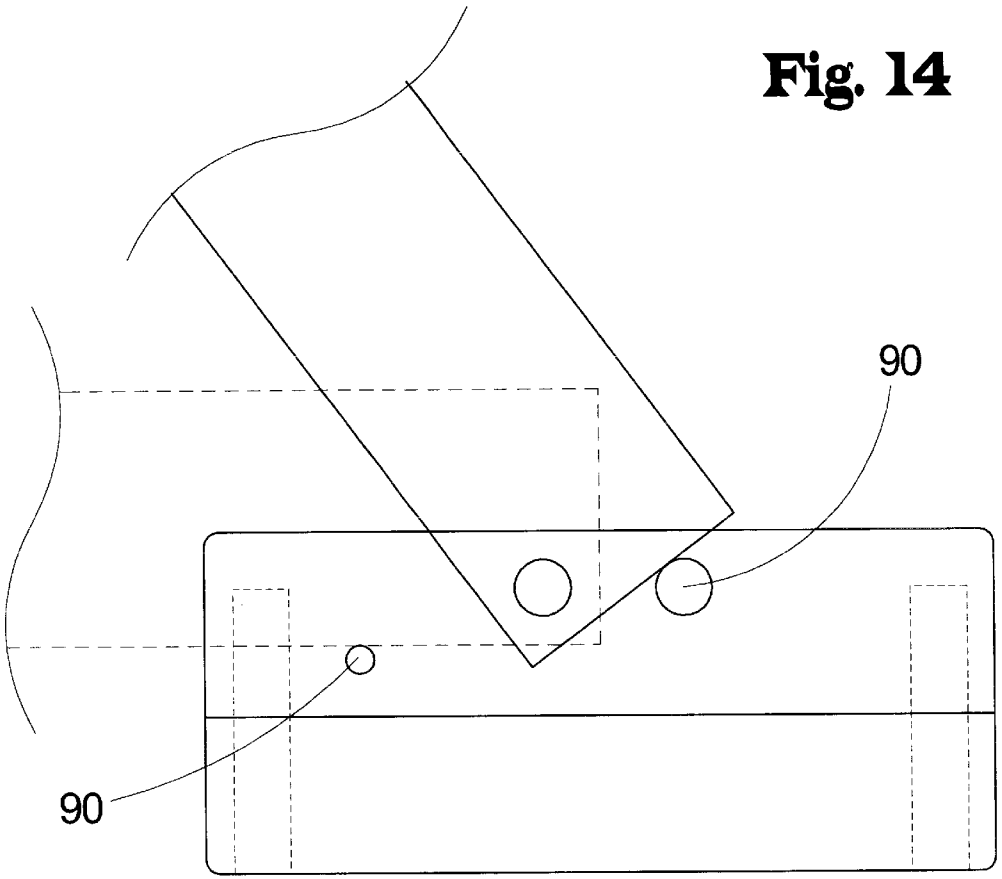
FIG. 14 is a side view of an alternate brake embodiment of the present invention.
Figure 15:
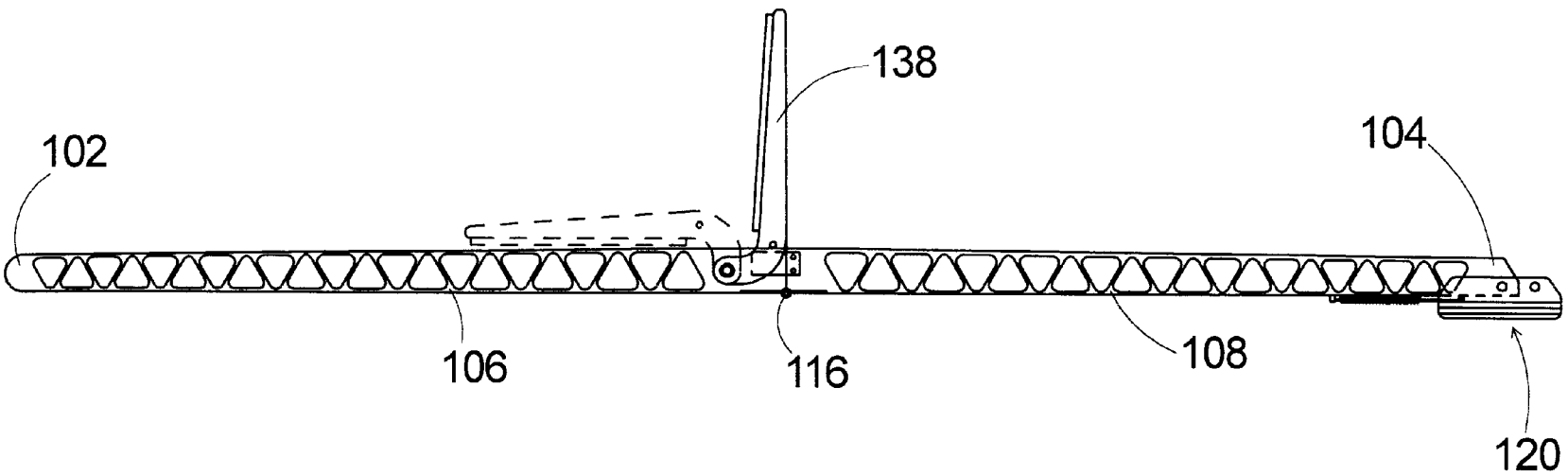
FIG. 15 is a schematic side view of an optional embodiment of the present invention particularly illustrating the stick in the extended deployed condition and the seat in the use position and in the stored position (in broken lines).
Figure 16:
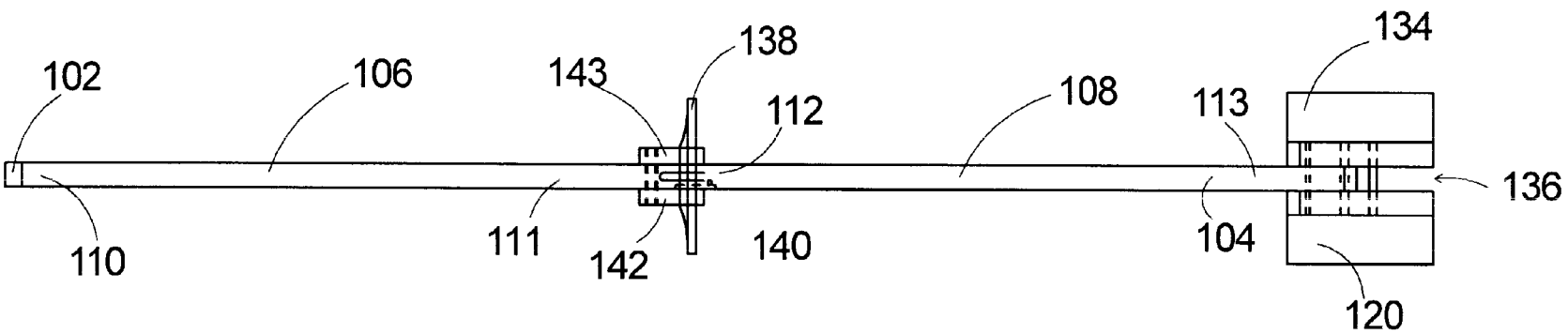
FIG. 16 is a schematic top view of the embodiment shown in FIG. 15.
Figure 17:
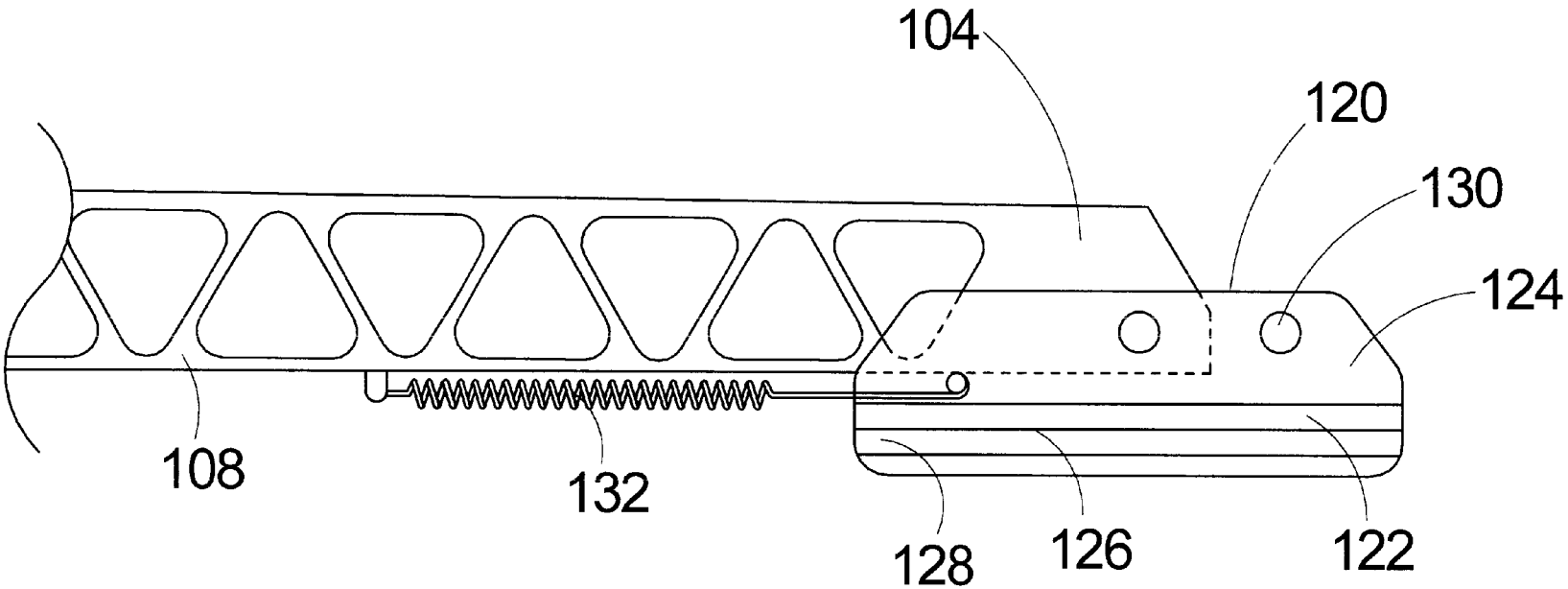
FIG. 17 is a schematic side view of a rear portion of the rearward component of the embodiment shown in FIG. 15 particularly illustrating the ground surface engagement member.
Figure 18:
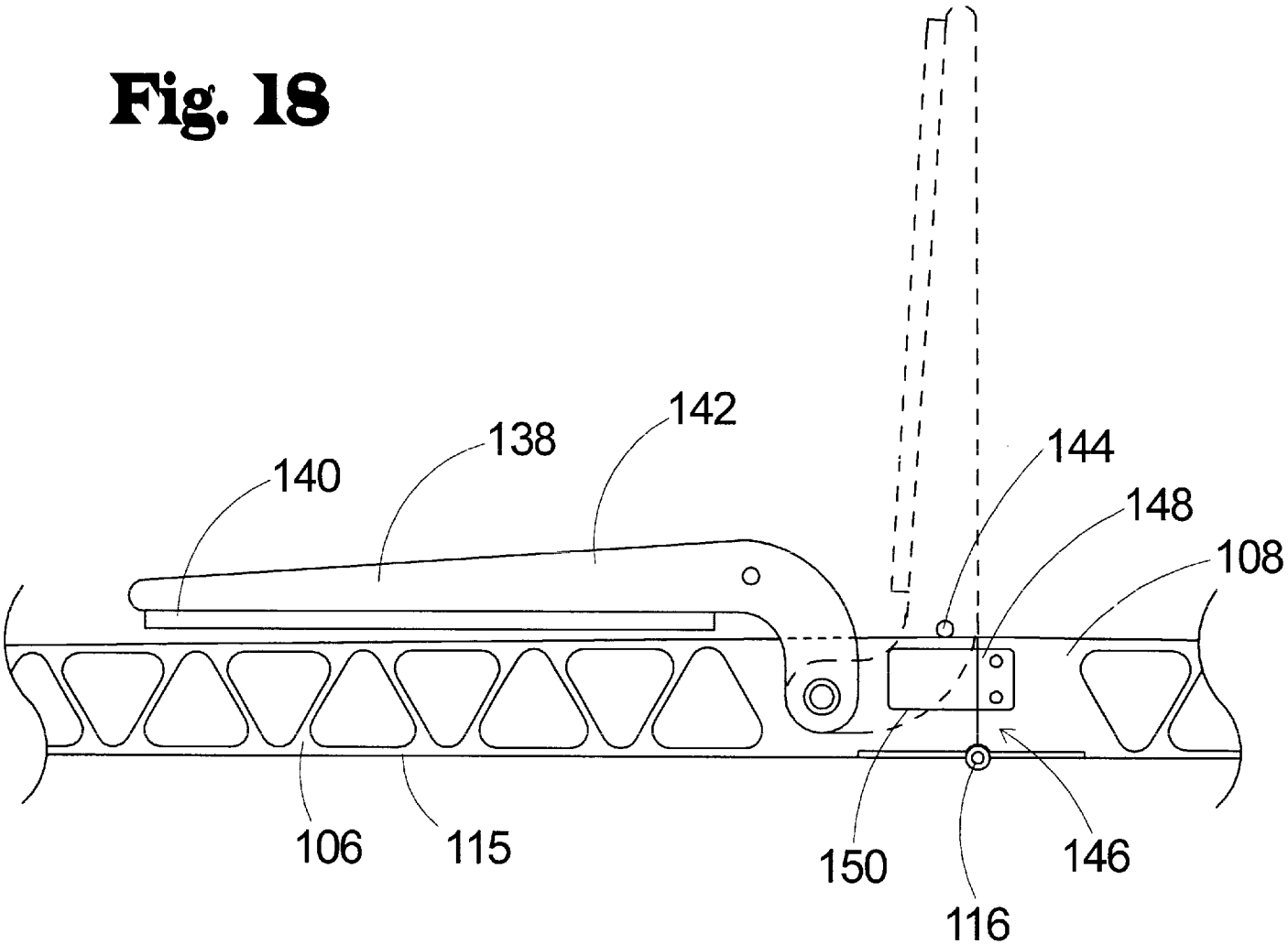
FIG. 18 is a schematic side view of a medial portion of the embodiment of FIG. 15 particularly illustrating the seat in the storage condition and in the use position in broken lines.
Figure 19:
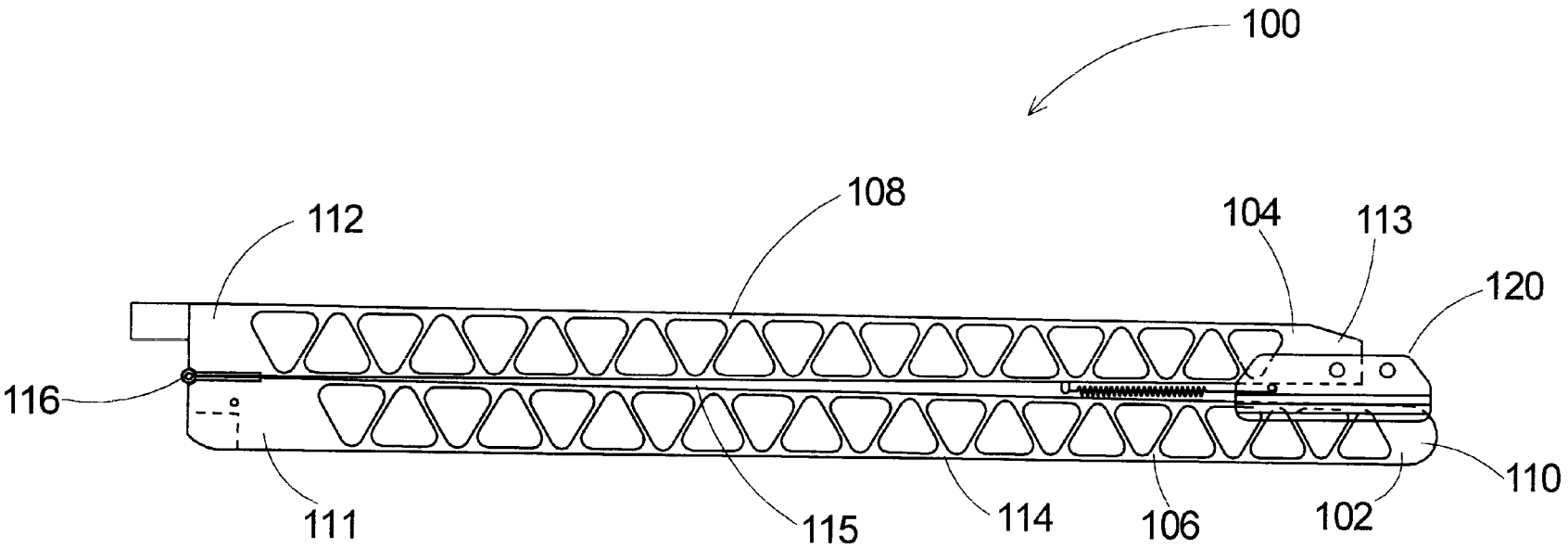
FIG. 19 is a schematic side view of the stick in the folded condition for storage (with the seat removed for clarity).

As shown in FIG. 14, the elongated bar may be pivotally coupled to the ground surface engagement member. Ideally, the ground surface engagement member has an aluminum top half to which the elongated bar is coupled and a rubber bottom half for braking purposes. By this structure, an angle between the ground surface engagement member and elongated bar is adjustable. Constraining the pivoting action of the ground surface engagement member is a pair of rotational stop pins 90 which are positioned as shown in FIG. 14 to allow movement of the ground surface engagement member through an angle of about 50 degrees. It should be noted that the stop pins extend inwardly from the associated ground surface engagement member a distance no more that ½ a width of the elongated bar, thereby allowing independent pivoting of both ground surface engagement members. As an option, the stop pins may interconnect the ground surface engagement members for coincident rotation.

A further significant aspect of the braking and seating device of the invention with optional features is shown in FIGS. 15 through 18. The elongated stick 100 has forward 102 and rearward 104 ends. The stick 100 most preferably comprises a forward component 106 and a rearward component 108. The forward component of the stick is pivotally mounted to the rearward component of the stick such that the components of the stick are pivotable between an extended deployed condition for use and a folded condition for storage. Preferably, the length of the forward and rearward components is substantially equal so that the length of the stick in the folded condition is minimized for the most compact storage size. The forward component 106 has a front end 110 and a rear end 111, and the rearward component 108 has a front end 112 and a rear end 113. The stick 100 also has an upper surface 114 and a lower surface 115.

A hinge 116 may be provided to couple the forward and rearward components. The hinge my be positioned along the lower surface of the forward and rearward components such the lower surfaces of the forward and rearward components are moved adjacent to each other when the components are in the folded condition.

A ground surface engagement member 120 is mounted on the rearward end 104 of the elongated stick. The ground surface engagement member is pivotally mounted on the rearward end for adapting to an orientation of a ground surface with respect to a longitudinal axis of the stick. The ground surface engagement member is thus mounted on the rear end of the rearward component. The ground surface engagement member includes a base member 122 with a flange portion 124 pivotally coupled to the rear end of the rearward component. The base member 122 has a brake surface 126. The engagement member includes a brake pad 128 mounted on the base member, with the brake pad being mounted on the brake surface. The brake pad 128 preferably comprises a wearable material.

The ground surface engagement member 120 may include a pivot stop 130 mounted on the flange portion 124 of the base member 122 for limiting the pivot movement of the ground surface engagement member. The engagement member may also include a biasing spring 132 linked between the stick and the ground surface engagement member for biasing the base member into a position having the brake surface oriented substantially parallel to a longitudinal axis of the stick.

Preferably, a pair 120, 134 of ground surface engagement members are included, with each of the ground surface engagement members being mounted on a side of the stick. The pair of ground surface engagement members define a gap 136 therebetween for receiving a portion of the forward component when the components are in the folded condition.

A seat 138 may be coupled to the stick. Preferably, the seat is pivotally mounted on the stick,.with the seat being pivotable between a use position and a storage position. The use position of the seat 138 is characterized by the seat being oriented substantially perpendicular to the stick and the storage position of the seat is characterized by the seat being oriented substantially parallel to the stick. The storage position of the seat being characterized by the seat being positioned adjacent to the upper surface of the stick. The seat is mounted on the forward component adjacent the rear end of the forward component. The seat preferably includes a seat plate 140 for supporting a user, and the seat plate may be substantially planar. The seat also may include a pair of seat support members 142, 143, with the seat support members being mounted on a lower surface of the seat plate. The seat support members may be oriented in a spaced and substantially parallel relationship with each of the seat support members being mounted on one side of the stick.

The seat may also include a stop pin 144 for blocking rotation of the seat beyond the use position. The stop pin preferably extends between the seat support members 142, 143.

Significantly, a latch mechanism 146 may be provided for selectively locking the components in the deployed condition. The latch mechanism may comprise a clip 148 mounted on a first one of the components and a pocket 150 for receiving a portion of the clip being mounted on the a second one of the components such that the portion of the clip is received in the pocket when the components are in the deployed condition. Ideally, but not critically, the rearward component comprises the first component and the forward component comprises the second component.

Preferably, the components of the stick each have a truss structure which permits a high strength material such as aluminum to be used while minimizing the weight of the stick.

Illustratively, the base member of the ground surface engagement member comprises a polycarbonite material, and the brake pad comprises a rubber material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A braking device for use with skates comprising:

an elongated stick having forward and rearward ends, the stick has an upper surface and a lower surface;

a ground surface engagement member mounted on the rearward end of the elongated stick; and a seat coupled to the stick, the seat being pivotally mounted on the stick, the seat being pivotable between a use position and a storage position, the use position being characterized by the seat being oriented substantially perpendicular to the stick and the storage position being characterized by the seat being oriented substantially parallel to the stick;

wherein the storage position of the seat is characterized by the seat being positioned adjacent to the lower surface of the stick.

2. The device of claim 1 wherein the stick has a forward and a rearward component, and wherein the forward component has a front end and a rear end, the rearward component having a front end and a rear end.

3. The device of claim 2 wherein a hinge couples the forward and rearward components, the hinge being positioned along the lower surface of the forward and rearward components such the lower surfaces of the forward and rearward components are moved adjacent to each other when the components are in the folded condition.

4. The device of claim 2 wherein the ground surface engagement member is mounted on the rear end of the rearward component.

5. The device of claim 2 wherein the ground surface engagement member comprises:

a base member with a flange portion pivotally coupled to the rear end of the rearward component, the base member having a brake surface; and a brake pad mounted on the brake surface of the base member.

6. The device of claim 5 additionally comprising a pivot stop mounted on the flange portion of the base member for limiting the pivot movement of the ground surface engagement member.

7. The device of claim 5 additionally comprising a biasing spring linked between the stick and the ground surface engagement member for biasing the base member into a position having the brake surface oriented substantially parallel to a longitudinal axis of the stick.

8. The device of claim 5 wherein the brake pad comprises a wearable material.

9. The device of claim 1 wherein the ground surface engagement member is pivotally mounted on the rearward end for adapting to an orientation of a ground surface with respect to a longitudinal axis of the stick.

10. The device of claim 1 wherein the stick has a forward and a rearward component, and wherein a pair of ground surface engagement members are included, each of the ground surface engagement members being mounted on a side of the stick, the pair of ground surface engagement members defining a gap therebetween for receiving a portion of the forward component when the components are in the folded condition.

11. The device of claim 1 wherein the seat comprises:

a seat plate for supporting a user;

a pair of seat support members, the seat support members being mounted on a lower surface of the seat plate, the seat support members being oriented in a spaced and substantially parallel relationship, each of the seat support members being mounted on one side of the stick; and a stop pin for blockings rotation of the seat plate beyond the use position, the stop pin extending between the seat support members.

12. The device of claim 1 additionally comprising a latch mechanism for selectively locking the components in the deployed condition.

13. The device of claim 12 wherein the latch mechanism comprises a clip mounted on a first one of the components and a pocket for receiving a portion of the clip being mounted on the a second one of the components such that the portion of the clip is received in the pocket when the components are in the deployed condition.

14. The device of claim 13 wherein the rearward component comprises the first component and the forward component comprises the second component.

15. A braking device for use with skates comprising:

an elongated stick having forward and rearward ends; and a ground surface engagement member mounted on the rearward end of the elongated stick, wherein the stick comprises a forward component and a rearward component, the forward component of the stick being pivotally mounted to the rearward component of the stick such that the components of the stick are pivotable between an extended deployed condition for use and a folded condition for storage, the forward component having a front end and a rear end, the rearward component having a front end and a rear end, the stick having an upper surface and a lower surface;

wherein a hinge couples the forward and rearward components, the hinge being positioned along the lower surface of the forward and rearward components such the lower surfaces of the forward and rearward components are moved adjacent to each other when the components are in the folded condition;

wherein the ground surface engagement member is pivotally mounted on the rearward end for adapting to an orientation of a ground surface with respect to a longitudinal axis of the stick;

wherein the ground surface engagement member comprises:

a base member with a flange portion pivotally coupled to the rear end of the rearward component, the base member having a brake surface;

a brake pad mounted on the brake surface of the base member;

a pivot stop mounted on the flange portion of the base member for limiting the pivot movement of the ground surface engagement member; and a biasing spring linked between the stick and the ground surface engagement member for biasing the base member into a position having the brake surface oriented substantially parallel to a longitudinal axis of the stick;

wherein the brake pad comprises a wearable material;

wherein an additional ground surface engagement member is included such that a pair of the ground surface engaging members are provided, each of the ground surface engagement members being mounted on a side of the stick, the pair of ground surface engagement members defining a gap therebetween for receiving a portion of the forward component when the components are in the folded condition;

a seat being coupled to the stick, the seat being pivotally mounted on the stick, the seat being pivotable between a use position and a storage condition, the use position being characterized by the seat being oriented substantially perpendicular to the stick and the storage position being characterized by the seat being oriented substantially parallel to the stick;

wherein the storage position of the seat being is characterized by the seat being positioned adjacent to the lower surface of the stick;

wherein the seat comprises:

a seat plate for supporting a user;

a pair of seat support members, the seat support members being mounted on a lower surface of the seat plate, the seat support members being oriented in a spaced and substantially parallel relationship, each of the seat support members being mounted on one side of the stick; and a stop pin for blocking rotation of the seat beyond the use position, the stop pin extending between the seat support members;

a latch mechanism for selectively locking the components in the deployed condition, the latch mechanism comprising a clip mounted on a first one of the components and a pocket for receiving a portion of the clip being mounted on the a second one of the components such that the portion of the clip is received in the pocket when the components are in the deployed condition;

wherein the rearward component comprises the first component and the forward component comprises the second component.

16. A braking device for use with skates comprising:

an elongated stick having forward and rearward ends;

a ground surface engagement member mounted on the rearward end of the elongated stick;

wherein the stick comprises a forward component and a rearward component, the forward component of the stick being pivotally mounted to the rearward component of the stick such that the components of the stick are pivotable between an extended deployed condition for use and a folded condition for storage, the forward component having a front end and a rear end, the rearward component having a front end and a rear end, the stick having an upper surface and a lower surface;

wherein the ground surface engagement member comprises:

a base member with a flange portion pivotally coupled to the rear end of the rearward component, the base member having a brake surface; and a brake pad mounted on the brake surface of the base member; and a pivot stop mounted on the flange portion of the base member for limiting the pivot movement of the ground surface engagement member.

17. A braking device for use with skates comprising:

an elongated stick having forward and rearward ends;

a ground surface engagement member mounted on the rearward end of the elongated stick;

wherein the stick comprises a forward component and a rearward component, the forward component of the stick being pivotally mounted to the rearward component of the stick such that the components of the stick are pivotable between an extended deployed condition for use and a folded condition for storage, the forward component having a front end and a rear end, the rearward component having a front end and a rear end, the stick having an upper surface and a lower surface;

wherein the ground surface engagement member comprises:

a base member with a flange portion pivotally coupled to the rear end of the rearward component, the base member having a brake surface; and a brake pad mounted on the brake surface of the base member; and a biasing spring linked between the stick and the ground surface engagement member for biasing the base member into a position having the brake surface oriented substantially parallel to a longitudinal axis of the stick.

18. The device of claim 17 additionally comprising a seat coupled to the stick, the seat being pivotally mounted on the stick, the seat being pivotable between a use position and a storage position, the use position being characterized by the seat being oriented substantially perpendicular to the stick and the storage position being characterized by the seat being oriented substantially parallel to the stick.

19. The device of claim 18 wherein the storage position of the seat is characterized by the seat being positioned adjacent to the lower surface of the stick.

* * * * *